US009881527B1

(12) United States Patent
Theobald, III

(10) Patent No.: US 9,881,527 B1
(45) Date of Patent: Jan. 30, 2018

(54) FLEXIBLE TENSIONED BANNER

(71) Applicant: C. J. Theobald, III, Louisville, KY (US)

(72) Inventor: C. J. Theobald, III, Louisville, KY (US)

( * ) Notice: Subject to any disclaimer, the term of this patent is extended or adjusted under 35 U.S.C. 154(b) by 0 days.

(21) Appl. No.: 15/434,776

(22) Filed: Feb. 16, 2017

Related U.S. Application Data

(60) Provisional application No. 62/334,003, filed on May 10, 2016.

(51) Int. Cl.
*G09F 17/00* (2006.01)
*G09F 7/18* (2006.01)
*G09F 15/00* (2006.01)

(52) U.S. Cl.
CPC ..... *G09F 17/00* (2013.01); *G09F 7/18* (2013.01); *G09F 15/0031* (2013.01); *G09F 2007/1886* (2013.01)

(58) Field of Classification Search
CPC ..... G09F 17/00; G09F 7/18; G09F 15/0031; G09F 2007/1886; E04H 15/40
See application file for complete search history.

(56) References Cited

U.S. PATENT DOCUMENTS 4,817,319 A * 4/1989 Vitale ..... G09F 7/18 40/603
4,866,866 A * 9/1989 Rotter ..... G09F 7/18 40/603
5,649,390 A * 7/1997 Davidson ..... B44C 5/00 160/179
6,938,863 B2 * 9/2005 LaMotte ..... G09F 15/0025 248/163.2
7,117,619 B1 * 10/2006 Huber ..... A63B 71/0672 116/222
7,424,864 B2 * 9/2008 McCann ..... G09F 15/0025 116/173
7,478,493 B2 * 1/2009 Brown ..... G09F 15/0025 248/165
7,900,386 B2 * 3/2011 Zheng ..... G09F 15/00 40/603
8,122,538 B2 * 2/2012 McBrearty ..... A47G 9/062 297/219.1
8,789,696 B2 * 7/2014 Imburgia ..... B65H 57/18 206/388
8,935,869 B2 * 1/2015 Aires ..... G09F 7/22 116/173
9,051,755 B2 * 6/2015 Heining ..... E04H 12/2253
2008/0236009 A1 * 10/2008 Venn ..... G09F 7/22 40/606.12

* cited by examiner

*Primary Examiner* — Gary C Hoge
(74) *Attorney, Agent, or Firm* — Duncan Galloway Egan Greenwald PLLC; Theresa Camoriano; Guillermo Camoriano

(57) ABSTRACT

A banner is made of a flexible sheet material with a casing. A resilient, flexible rod extends through the casing and has first and second ends anchored at fixed, spaced-apart positions so that the resilient, flexible rod forms an arcuate shape and holds the flexible sheet material in tension to form a flexible, arcuate-shaped, tensioned banner.

11 Claims, 9 Drawing Sheets

FLEXIBLE TENSIONED BANNER

BACKGROUND

Many types of signs and banners are known. Signs that are intended for outdoor use need to be able to withstand substantial wind forces. Feather banners are made with a flexible sheet material, such as cloth, mounted onto a flexible rod, which is secured to the ground at one point. These feather banners have a flexible rod on one elongated side and along part of the top side of the flexible sheet material, and the other elongated side is free to flap in the breeze. This has the advantage that the flapping movement attracts attention, but it has the disadvantage that the flat face of the banner does not always face in the same direction and is not always visible from the desired point. For example, the rod may swivel about its axis, which causes the banner to swivel, or the banner may swivel about the rod.

Other banners made of flexible sheet material have a generally rectangular shape and are securely anchored along both their left and right sides by rigid pipes or posts (and sometimes along their top side as well), so they always face in the desired direction. However, these banners do not last very long under outdoor conditions, because they receive the full force of, and are badly beaten by, the wind. The result is that the message or image on the banner becomes difficult to see, and becomes damaged and deteriorated, which gives a bad impression to the viewer over time. Sometimes, cuts are made through these banners to try to provide a relief from the force of the wind, but the cuts do not help solve the problem.

SUMMARY

The present invention provides a banner made of a flexible sheet material, such as cloth or polyurethane sheet, that is mounted onto a flexible rod that extends through a casing on the banner to form an arch that is anchored at both ends. This provides a generally planar sign that always faces in the desired direction. Because the rod is flexible, this sign flexes in the wind, which provides movement that attracts attention. The flexing also allows the sign to bend and twist in response to the wind forces, to reduce the resistance to the wind. This allows the wind to pass by the sign without the banner receiving the full force of the wind, thereby protecting the flexible sheet material from being beaten up as in the case of a normal banner that is rigidly fixed in position along both its left and right sides. As a result, the message or image on the banner remains attractive, readable, and professional-looking for long periods of time. The flexible rod extends through a casing on the flexible sheet material, with both ends of the flexible rod being anchored.

DESCRIPTION

Figures 1, 2:
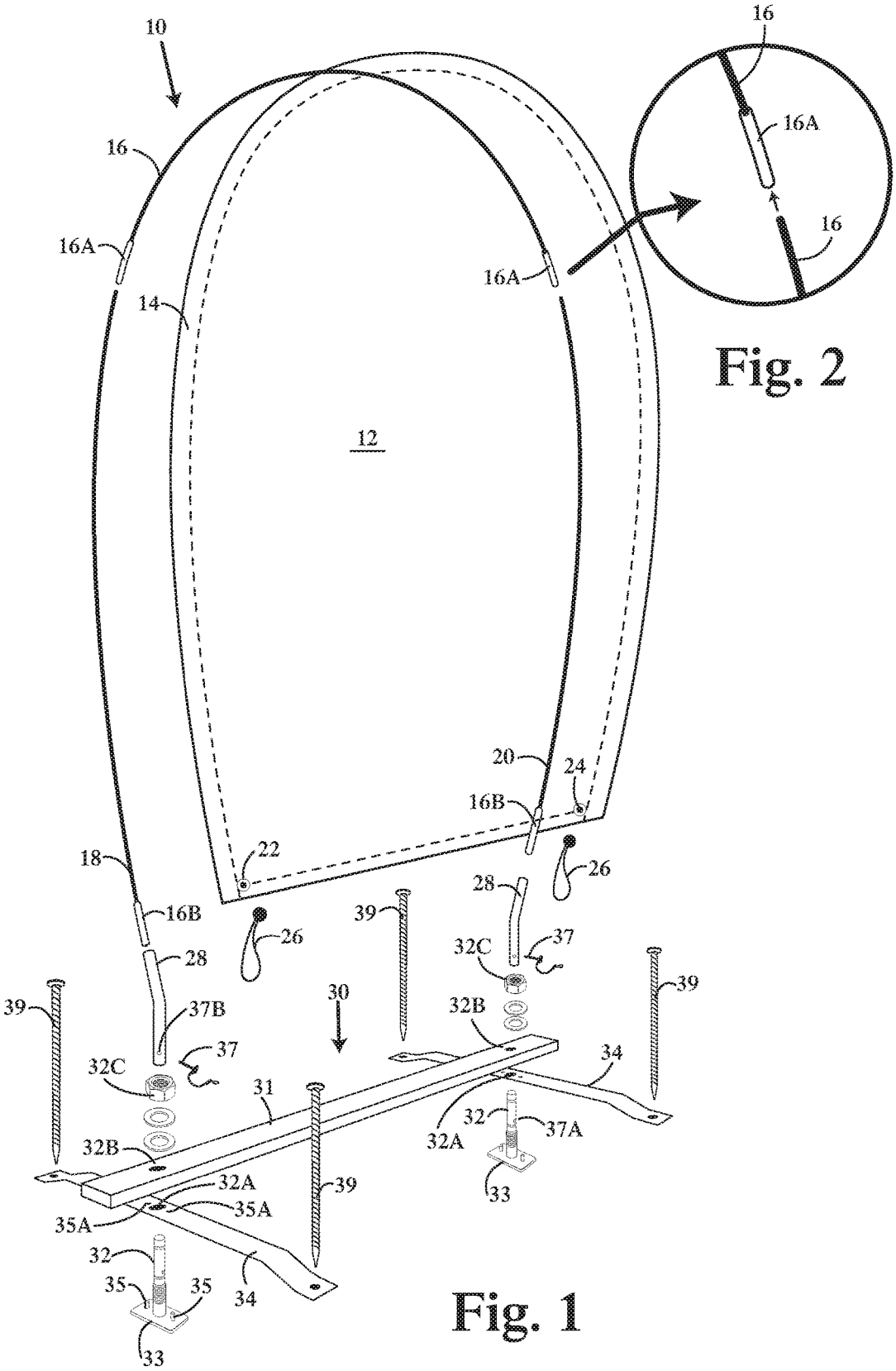
FIG. 1 is an exploded perspective view of a first embodiment of a flexible tensioned banner.
FIG. 2 is an enlarged view of a portion of the flexible rod of the flexible tensioned banner of FIG. 1.
Figure 3:
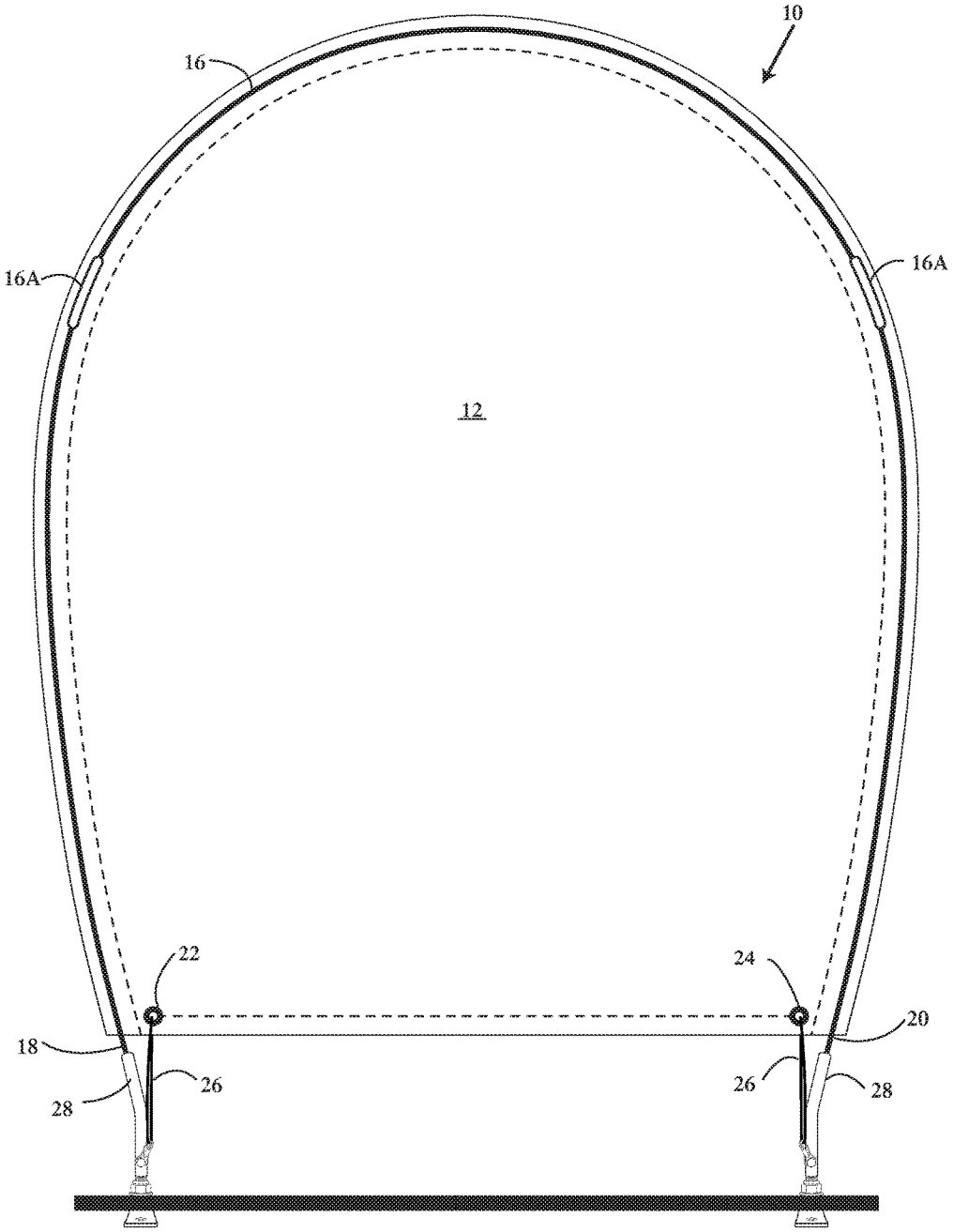
FIG. 3 is a front view of the assembled, flexible tensioned banner of FIG. 1.

As shown in FIGS. 1-3, the flexible tensioned banner 10 is made up of a flexible sheet material 12 with a casing 14 extending around the left side, top, and right side of the flexible sheet material 12. The flexible sheet material 12 is supported by a resilient, flexible rod 16 that extends through the casing 14, with both the first end 18 and the second end 20 of the resilient, flexible rod 16 being securely anchored by anchors 28, as will be described later. This embodiment is about two feet wide and about four feet tall. It also may be scaled up to be four feet wide and eight feet tall, and to be various other sizes.

The flexible, resilient rod 16 is made of a strong, resilient material, such as fiberglass, carbon fiber, or other materials such as those used for fishing rods, and lies in a straight line when at rest. When the rod 16 is bent into an arcuate shape to extend through the arcuate-shaped casing 14 and its ends 18, 20 are inserted into the anchors 28, there is a spring tension in the rod 16 which wants to return the rod 16 to its original, straight shape. This spring tension keeps the rod 16 pressed against the anchors 28 and keeps the flexible sheet material 12 stretched and in tension.

The flexible sheet material 12 cannot stand up on its own. If the resilient, flexible rod 16 were not present to provide support, the flexible sheet material 12 would fall down to the ground. In this embodiment, the resilient, flexible rod 16 is made in pieces with their ends nested together, like a fishing rod. A tubular fitting (ferrule) 16A is pressed onto each end of an intermediate rod portion and receives the end of the next adjacent rod portion with a snug fit. Similarly, a tubular fitting (ferrule) 16B is pressed onto each of the first and second ends 18, 20 of the flexible rod 16 and slidably nests with the respective anchor 28 to anchor the first and second ends 18, 20 of the flexible rod 16.

The first end 18 of the resilient, flexible rod 16 slidably nests with a first anchor 28, and the second end 20 of the resilient, flexible rod 16 slidably nests with a second anchor 28. The anchors 28 are fixed to the base 30 in a non-movable position. In this embodiment, the anchors 28 are tubular and have an inside diameter larger than the outside diameter of the fittings 16B at the ends 18, 20 of the flexible rod 16, so the ends 18, 20 nest inside the respective anchors 28. In an alternative embodiment (not shown), the fittings 16B at the ends 18, 20 could be tubular, with an open bottom and with a larger inside diameter than the anchors 28, so the anchors 28 would slidably nest inside the fittings 16B at the ends 18, 20 of the rod 16 in order to nest the ends 18, 20 of the rod 16 with the anchors 28. In either case, the mating, slidably nested surfaces of the fittings 16B at the ends 18, 20 and the respective anchors 28 are generally cylindrical, which permits the ends 18, 20 to rotate about their axes and to slide in an axial direction relative to the anchors 28 to facilitate the flexing of the flexible rod 16 in response to wind currents, while keeping the ends 18, 20 located at defined, spaced-apart locations and at defined angles, as defined by the anchors 28.

Since the upper portions of the anchors 28 are coaxial with the ends 18, 20 of the rod 16 when the ends 18, 20 and anchors 28 are nested together, the anchors 28 not only define the spacing and locations of the ends 18, 20; they also define the angles of the ends 18, 20.

The ends 18, 20 of the rod 16 are retained in their nested position with the anchors 28 by a combination of forces. First, the spring force of the arcuate rod 16, which is trying to return to a straight, non-arcuate shape, exerts a lateral force on the anchors 28, which creates friction that helps retain the ends 18, 20 of the rod 16 in their nested position with the anchors 28. This is true whether the anchors 28 have the larger diameters and receive the ends 18, 20, as shown here, or the ends 18, 20 have the larger diameters and receive the anchors 28.

Second, there are grommets 22, 24 at the lower left corner and lower right corner of the flexible sheet material 12 which receive elastic tethers 26, that are used to tie down the flexible sheet material 12 to the base 30. The elastic tethers 26 pulling downwardly on the flexible sheet material 12 cause the sheet material 12 to exert a downward force on the rod 16 that helps retain the ends 18, 20 in their nested position. In addition, gravity acts on the sheet material 12 and rod 16, exerting a downward force that helps retain the ends 18, 20 in their nested position.

Both of the anchors 28 are fixed to the base 30 in a fixed position, as described below. The base 30 rests on the ground. In this embodiment, the base 30 is secured to the ground with spikes 39. Alternatively, the base may be held in place with ballasts or by other known means.

The base 30 includes a main elongated member 31 and left and right outriggers 34, which extend crosswise across the main elongated member 31 at the left and right ends of the main elongated member 31. A threaded shaft 32 projects upwardly through an opening 32A in each outrigger 34 and through an aligned opening 32B in the main elongated member 31. Each threaded shaft 32 is welded to a foot 33 at the bottom end of the shaft 32, and each foot 33 has first and second upwardly-directed nubs 35 that are received through respective openings 35A in the respective outrigger 34 and in aligned recesses (not shown) in the bottom surface of the main elongated member 31 to prevent the threaded shaft 32 from rotating relative to the outrigger 34 and to prevent the outriggers 34 from rotating relative to the main elongated member 31.

A lock nut 32C is threaded onto each threaded shaft 32, securing the threaded shaft 32 to the main elongated member 31 of the base 30, with the threaded shafts 32 in fixed, spaced-apart positions on the main elongated member 31 of the base 30.

A tubular anchor 28 is then slid over the end of each threaded shaft 32 and is secured in place by a pin 37 that extends through aligned openings 37A, 37B in the shaft 32 and the anchor 28, respectively. The lower part of the anchor 28 is vertical, to fit over the vertical shaft 32. The upper part of the tubular anchor 28 lies at a desired angle to the lower part to define the angles of the ends 18, 20, which helps form the desired banner shape.

In this particular embodiment, the angle between the lower part and the upper part of the tubular anchor is 165 degrees, with the angles directed leftwardly and rightwardly, respectively, when the tubular anchors 28 are assembled and pinned. As will be shown in other embodiments described later, the angle between the lower part and the upper part of the anchor 28 and the length of the rod 16 may be selected as desired, to create a variety of shapes. (If the anchors 28 are to be nested inside the ends 18, 20, the anchors 28 may be solid rods that are anchored into the ground in concrete, if desired.)

To assemble the banner, the flexible rod 16 is inserted through the casing 14, and the ends 18, 20 of the flexible rod 16 that project beyond the casing 14 are simply slipped into (or onto) the respective anchors 28, and the elastic tethers 26 are secured at their first end to a respective grommet 22, 24 and at their second end to a respective threaded shaft 32 at a point spaced below the bottom of the flexible sheet 12. In this particular embodiment, the elastic tethers 26 have an enlargement at their first end that is too large to fit through the respective grommet 22, 24. The second end of each elastic tether 26 is pulled through its respective grommet 22, 24 until the enlargement abuts the respective grommet 22, 24, and each elastic tether 26 forms a loop that receives the respective pin 37 to secure the second end of the elastic tether 26 to the threaded shaft 32. So, in this embodiment, the same pin 37 mounts the anchor 28 and the elastic tether 26 to the base 30.

When assembled, the elastic tethers 26 are in tension, pulling downwardly on the sheet material 12 of the banner, and the flexible rod 16 pushes upwardly and outwardly against the casing 14 to keep the sheet material 12 taut and in tension.

While the enlargements and pins are used in this embodiment to secure the elastic tethers 26, the elastic tethers 26 could be secured to the grommets 22, 24 and to the base 30 in other ways, such as by tying.

The main elongated portion 31 of the base 30, the threaded shaft 32, tubular anchors 28, nuts 32C, and outrigger feet 34 are made of metal and are more rigid than the resilient, flexible rod 16. The resilient, flexible rod 16 is more rigid than the flexible sheet material 12.

In this embodiment, the resilient, flexible rod 16 is made of a carbon composite, but other known materials could be used, such as fiberglass or other materials, such as those that are used for resilient, flexible fishing rods.

Figures 4A, 4B, 4C, 4D, 4E, 4F, 4G:
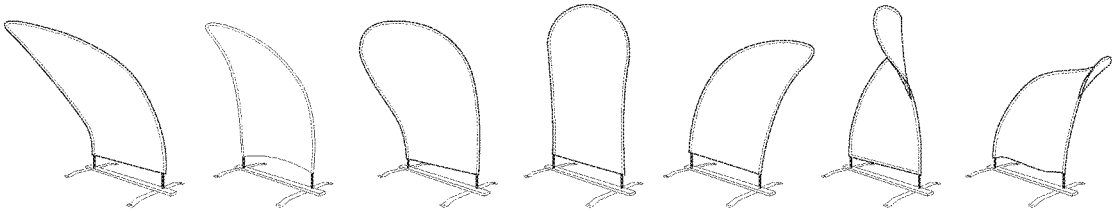
FIGS. 4*a*-4*g* are views of the flexible tensioned banner of FIG. 1 as it flexes in response to wind forces.

FIGS. 4*a*-4*g* show how the resilient, flexible rod 16 and the flexible sheet material 12 flex in the wind. In FIG. 4*a*, the tensioned banner 10 flexes forwardly to reduce its height in order to reduce its resistance to the wind and to allow the wind to pass over it. In FIG. 4*e*, the tensioned banner 10 flexes rearwardly in the same manner. FIGS. 4*b*, 4*c*, 4*f* and 4*g* show the tensioned banner 10 not only flexing forwardly or rearwardly but also twisting in response to the wind in order to reduce its resistance to the wind. Due to the nested mounting arrangement between the ends 18, 20 of the flexible rod 16 and the anchors 28, the ends 18, 20 are free to rotate enough about their axes and slide enough in the axial direction relative to the anchors 28 to facilitate the bending and flexing of the flexible rod 16 in response to the forces of the wind currents, while still keeping the ends 18, 20 and the respective anchors 28 nested together.

The resilient, flexible rod 16 keeps the flexible sheet material 12 in tension as the tensioned banner 10 flexes. This means that any text or pictures or other printed matter on the banner will continue to face in the desired direction and will remain tensioned so it can be seen from the desired direction. It also means that the flexible sheet material 12 will last much longer than if the same flexible sheet material were fixed along its left and right sides to a rigid pipe or fence post or other rigid material that did not allow the flexible sheet material 12 to flex in order to reduce its resistance to the wind.

FIGS. 5-10 show examples of a few of the various sizes and shapes of flexible tensioned banners that are contemplated in addition to the embodiment shown in FIGS. 1-3. These tensioned banners are made in the same way as the first embodiment, but their shapes and dimensions are different.

Figure 5:
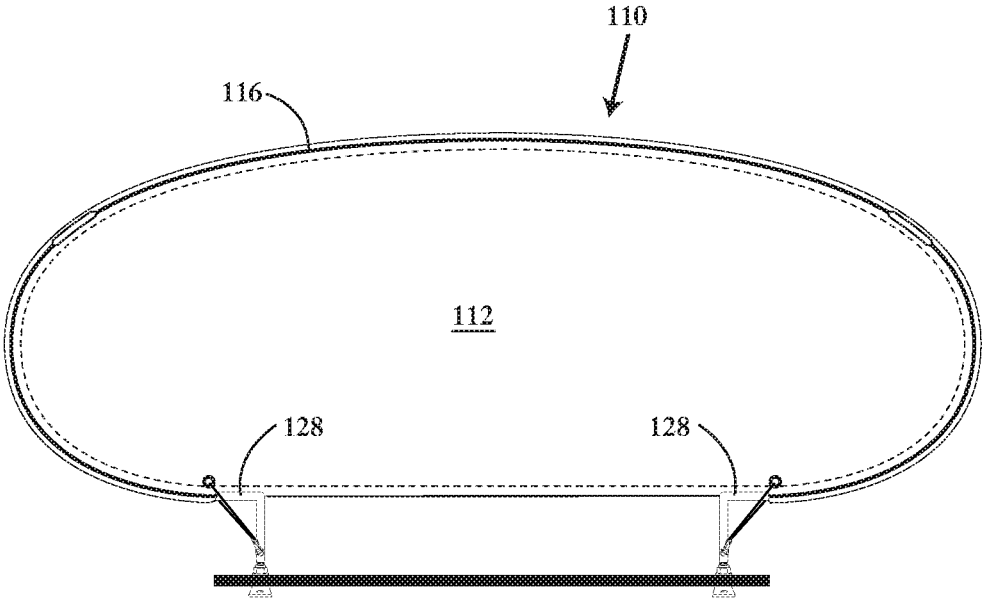
FIGS. 5-10 are views of various alternative shapes for the flexible tensioned banner.

FIG. 5 shows a banner 110 with a flexible sheet material 112, flexible rod 116, and anchors 128 forming an oval shape that is wider than it is tall. In this embodiment, the angle between the top and bottom portions of the anchors 128 is 90 degrees.

Figure 6:
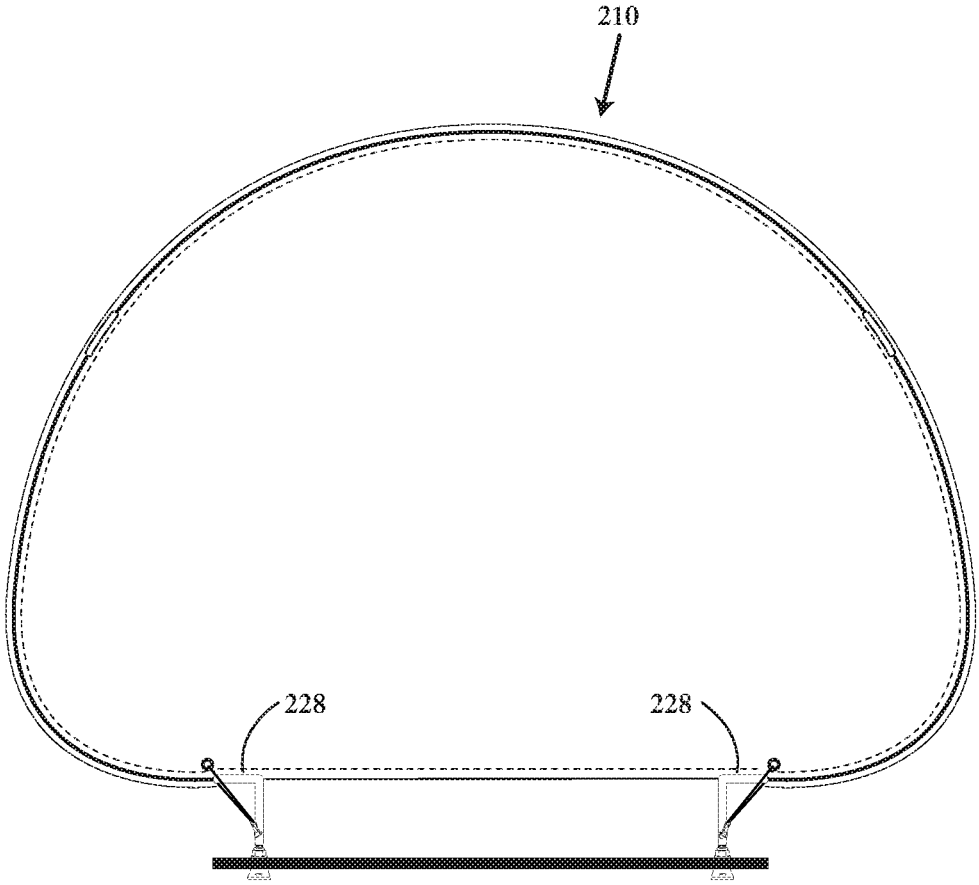

FIG. 6 shows another banner 210 in which the angle between the top and bottom portions of the anchors 228 is 90 degrees. This banner 210 has a height that is about the same as its width.

Figure 7:
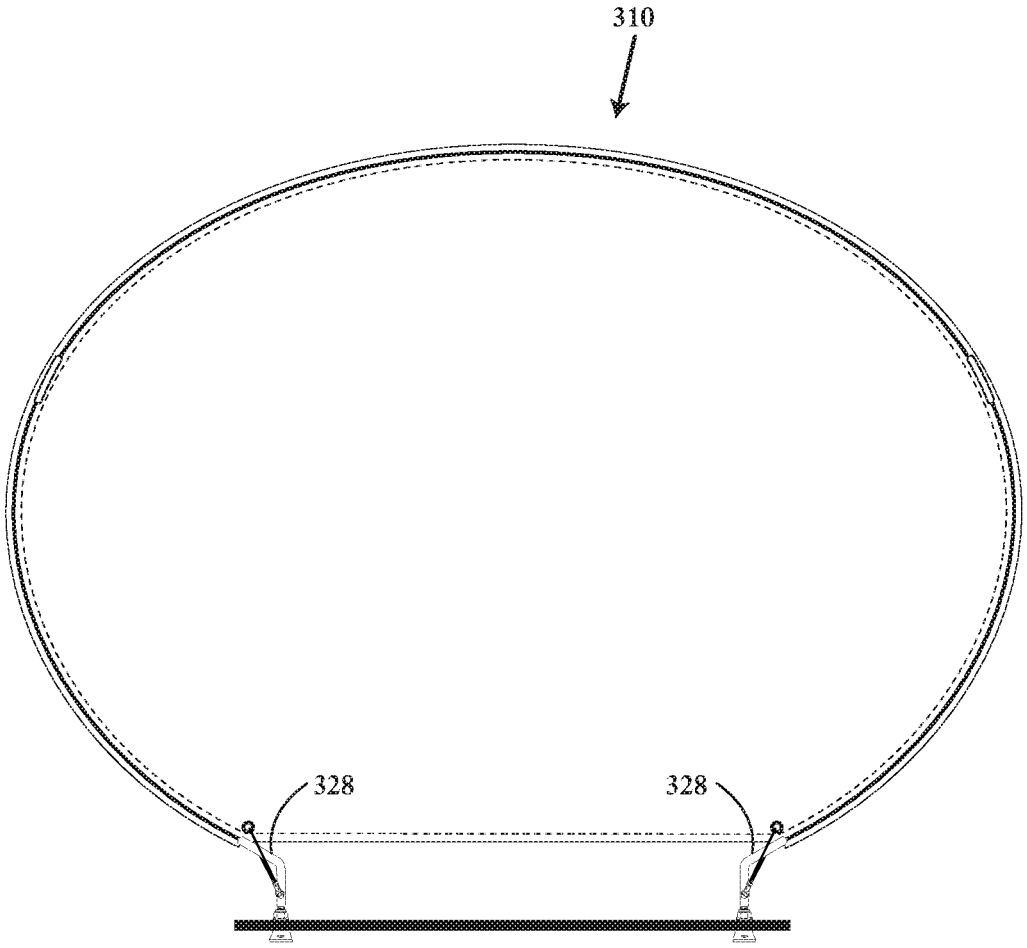

FIG. 7 shows another banner 310. In this embodiment, the angle between the top and bottom portions of the anchors 328 is 120 degrees.

Figure 8:
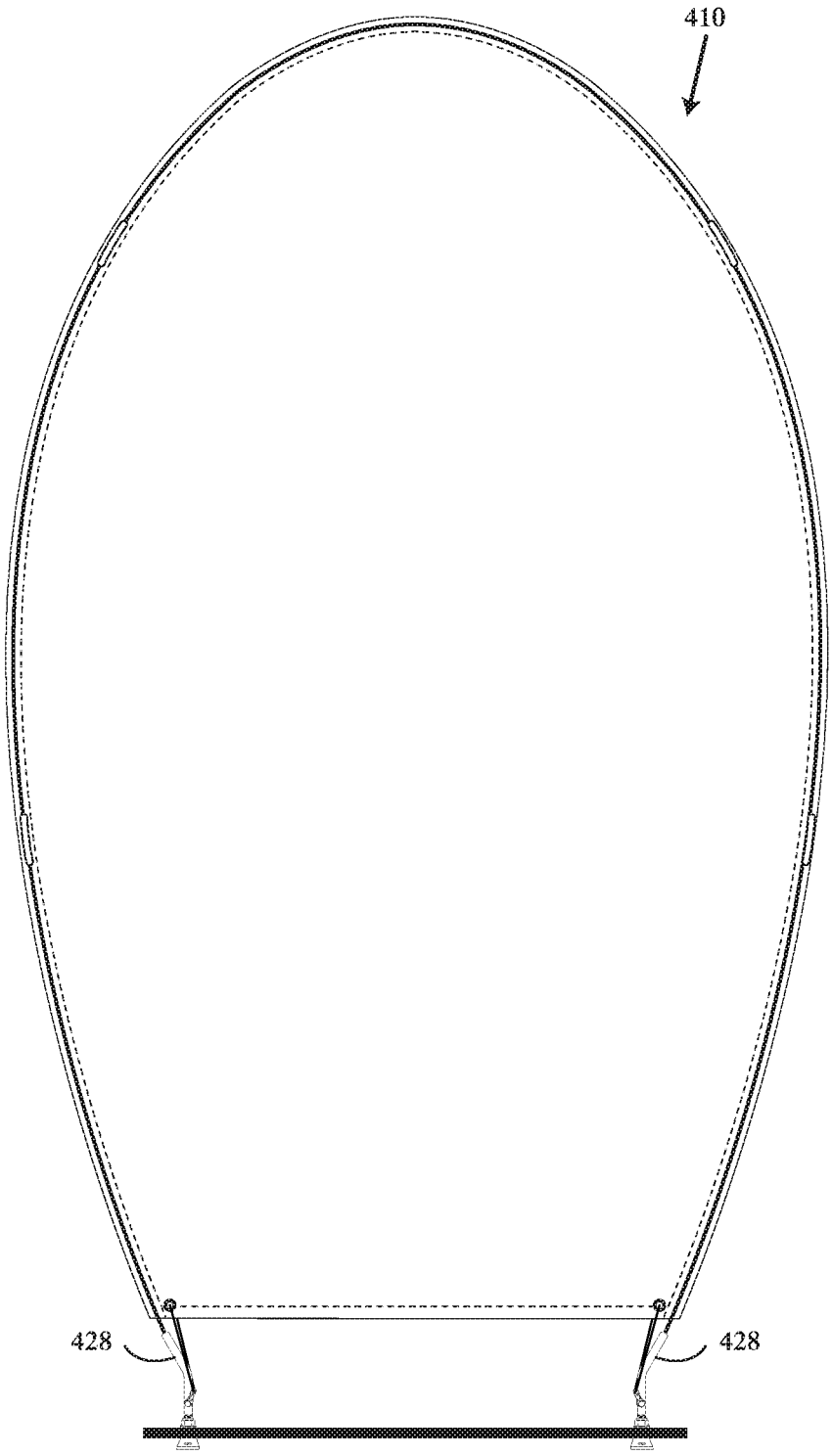

FIG. 8 shows another banner 410. In this embodiment, the angle between the top and bottom portions of the anchors 428 is 150 degrees. This embodiment is about twice as tall as it is wide.

Figure 9:
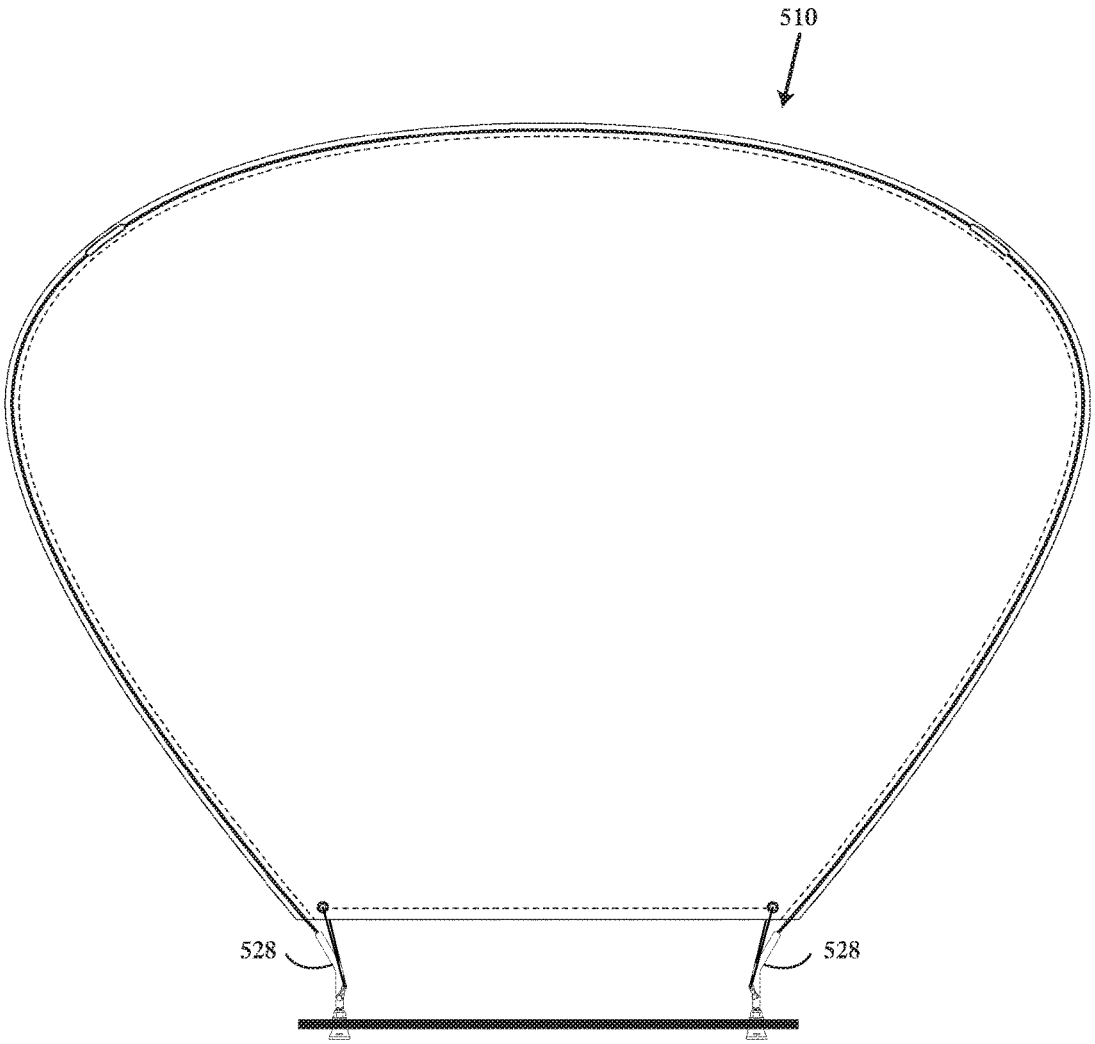

FIG. 9 shows another banner 510. In this case the angle of the anchors 528 is again 150 degrees.

Figure 10:
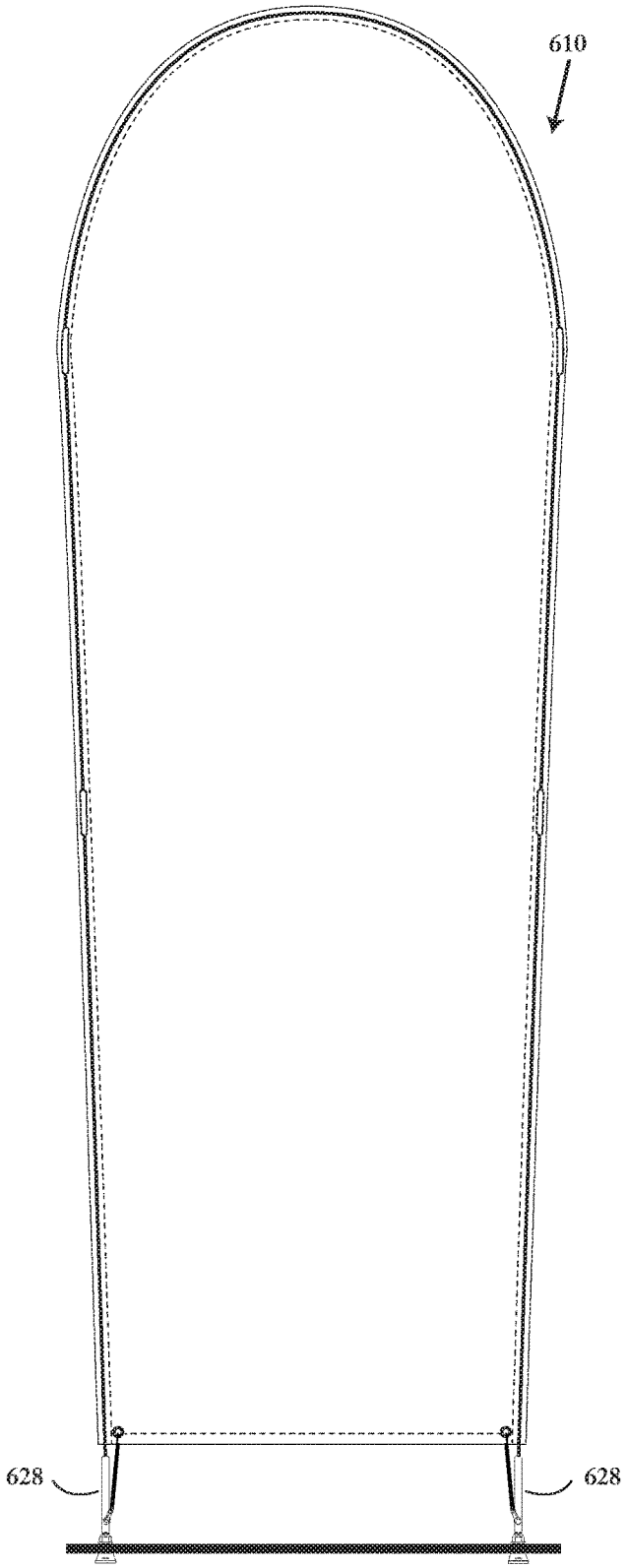

FIG. 10 shows another banner 610. In this case, the tubular anchors 628 are straight, with the upper portion being at an angle of 180 degrees to the bottom portion.

An infinite number of shapes and dimensions is possible. While these views show the flexible sheet material 12 as being a single ply with no printing on it, it may be desirable to make the flexible sheet 12 out of two sheets of material such as nylon with a barrier sheet such as mylar between them to form a three-ply sheet 12. The nylon sheets would have printing on them, and the mylar sheet between them provides a barrier so a person only sees the printing on one side of the banner at a time. So, for example, when a person is looking at the front of the banner, he sees only the image printed on the front side and does not see through to the image that is printed on the back side.

It has been found that a polyurethane sheet with a white pigment makes a good flexible sheet material 12. It does not absorb water, and it can be printed on both sides and is opaque, so the image printed on one side cannot be seen from the other side.

The casing 14 that receives the flexible rod 16 may be formed simply by folding over the flexible banner material 12 and sewing a hem recessed in from the folded edge. In another alternative, a separate casing material may be sewn onto the banner to form the casing 14 that receives the rod 16. In another alternative, the flexible material 12 is a polymer that can be welded by heat, and the casing 14 may be formed by folding over the edge of the flexible material and welding a hem or by welding on a separate piece. Another alternative way to form the casing is by gluing the banner material 12 to itself or to another material.

While in the embodiments described above, the casing 14 is along the perimeter of the sheet material 12, it would be possible for the sheet material 12 to extend beyond the casing 14, with the portion of the sheet material 12 that extends beyond the casing 14 hanging loosely from the arcuate frame formed by the resilient, flexible rod 16 and not being in tension.

It will be obvious to those skilled in the art that additional modifications may be made to the embodiments described above without departing from the scope of the invention as claimed.

What is claimed is:

1. A banner, comprising:

a flexible sheet material having left and right sides, a top and a bottom;

a casing formed along said left and right sides and said top;

a resilient, flexible rod extending through said casing, along the left side, top, and right side of said flexible sheet material, said resilient, flexible rod having first and second rod ends anchored to first and second fixed anchors located at first and second spaced-apart positions, so that said resilient, flexible rod forms an arcuate shape and holds said flexible sheet material in tension to form a flexible, arcuate-shaped, tensioned banner;

wherein said first rod end and said first fixed anchor are slidably nested together, and said second rod end and said second fixed anchor are slidably nested together;

wherein said first and second rod ends and said first and second fixed anchors have a cylindrical shape that permits rotation of said first and second rod ends relative to said respective first and second fixed anchors to facilitate the flexing of said flexible rod in response to forces created when said flexible sheet material is acted on by an air current;

and further comprising left and right elastic tethers, each of said elastic tethers having a first tether end and a second tether end, with each of said first tether ends secured to said flexible sheet material and each of said second tether ends fixed at a respective fixed mounting point spaced below said bottom.

2. A banner as recited in claim 1, wherein said first and second rod ends nest inside said respective first and second fixed anchors.

3. A banner as recited in claim 1, wherein said flexible, arcuate-shaped, tensioned banner is generally planar when at rest and flexes to a variety of non-planar shapes when acted upon by wind currents.

4. A banner as recited in claim 3, and further comprising left and right grommets on said bottom, wherein the first end of said left elastic tether is secured to said left grommet and the first end of said right elastic tether is secured to said right grommet.

5. A banner as recited in claim 4, wherein each of said first tether ends comprises an enlarged body that is too large to fit through said respective grommet, and wherein each of said second tether ends includes a loop secured by a respective pin at said respective fixed mounting point.

6. A banner as recited in claim 1, wherein said casing is formed by sewing.

7. A banner as recited in claim 1, wherein said flexible sheet material is made of a polymer and said casing is formed by melting and welding said flexible sheet material.

8. A banner as recited in claim 1, wherein said casing is formed by gluing.

9. A banner as recited in claim 1, wherein said flexible sheet material extends across said arcuate shape formed by said resilient, flexible rod.

10. A banner as recited in claim 9, wherein, when at rest, said flexible sheet material is planar, and, when acted upon by wind currents, said flexible rod and said flexible sheet material flex together into a variety of non-planar shapes, with said flexible sheet continuing to be held in tension extending across said arcuate shape formed by said resilient, flexible rod.

11. A banner as recited in claim 1, wherein said first and second elastic tethers pull downwardly on said flexible sheet material, causing said flexible sheet material to exert a downward force on said flexible rod; wherein said downward force provided by said tethers acts together with a downward force of gravity to help retain said first and second rod ends on said first and second fixed anchors.

* * * * *